US006339737B1

(12) United States Patent
Yoshimura et al.

(10) Patent No.: US 6,339,737 B1
(45) Date of Patent: Jan. 15, 2002

(54) DATA STORAGE OF CONSTRUCTION MACHINE AND DATA PROCESSOR

(75) Inventors: Hiroshi Yoshimura; Koichi Kawamura, both of Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/346,695

(22) Filed: Jul. 2, 1999

(30) Foreign Application Priority Data

Jul. 7, 1998 (JP) ..... 10-191729

(51) Int. Cl.[7] ..... G60F 17/40
(52) U.S. Cl. ..... 701/50; 701/35
(58) Field of Search ..... 701/50, 29, 30, 701/32, 33, 34, 35

(56) References Cited

U.S. PATENT DOCUMENTS 4,939,652 A * 7/1990 Steiner ..... 701/35
5,325,082 A * 6/1994 Rodriguez ..... 340/438
5,659,470 A * 8/1997 Goska et al. ..... 701/35
5,745,864 A * 4/1998 Hosoe et al. ..... 701/35
5,802,545 A * 9/1998 Coverdill ..... 701/35
5,857,159 A * 1/1999 Dickrell et al. ..... 701/35
5,889,671 A * 3/1999 Autermann et al. ..... 364/188
5,968,107 A * 10/1999 Vogan et al. ..... 701/102
6,073,063 A * 6/2000 Ong et al. ..... 701/35

* cited by examiner

*Primary Examiner*—Michael J. Zanelli
*Assistant Examiner*—E Gibson
(74) *Attorney, Agent, or Firm*—Varndell & Varndell, PLLC

(57) ABSTRACT

Storage of data which changes during the operation of a construction machine and processing of data can be performed at a low cost by using existing sensors and switches mounted on the construction machine. In an operation section of a controller, each level for indicating a content of a detection signal of each sensor or an instruction signal of a switch is determined first. Then, the detection signal to be input is judged to belong to which of the respective levels at every sensor readout interval (sampling time), and a count value of the level to which the detection signal was judged to belong is processed to add for a portion of the sampling time. And, a time count value at every level stored in a storage section is read from the outside to perform the data processing.

18 Claims, 9 Drawing Sheets

| | PUMP DISCHARGE PRESSURE HISTOGRAM | ENGINE SPEED HISTOGRAM | OPERATION MODE HITOGRAM | USE WORK MACHINE HISTOGRAM | WATER TEMPERATURE HITOGRAM | ENGINE ON TIME (ACTUAL OPERATION TIME HISTOGRAM) | ACTUAL OERATION TIME (ACTUAL OPERATION TIME HISTOGRAM) | ERROR HISTORY (ACTUAL OPERATION TIME HISTOGRAM) | HORSEPOWER HISTOGRAM |
|---|---|---|---|---|---|---|---|---|---|
| PUMP PRESSURE SENSOR 10 | ○ | | | | | | | | |
| ENGINE SPEED SENSOR 13 | | | | | | | | | ○ |
| GOVERNOR MOTOR POTENTIOMETER 12 | | | | | | ○ | ○ | | ○ |
| ENGINE WATER TEMPERATURE SENSOR 11 | | | | | ○ | | | | |
| ENGINE OIL AMOUNT SENSOR | | | | | | | | | |
| ENGINE OIL PRESSURE SWITCH | | | | | | | | | |
| WORK MACHINE PRESSURE SWITCH 9 | (○) | (○) | (○) | ○ | | | ○ | | (○) |
| RADIATOR WATER LEVEL SENSOR | | | | | | | | | |
| FUEL LEVEL SENSOR 14 | | | | | | | | | |
| WORK OIL LEVEL SENSOR | | | | | | | | | |
| AIR CLEANER CLOG SENSOR | | | | | | | | | |
| KEY SWITCH 19 | | | | | | ○ | | | |
| FUEL DIAL | | | | | | | | | (○) |
| OPERATION MODE SWITCH 15 | | | ○ | | | | | | ○ |
| MOVING SPEED SWITCH | | | | | | | | | |
| KNOB SWITCH | | | | | | | | | |
| OTHERS | | | | | | | | | ENGINE TORQUE CURVE |

FIG.3

| | ACTUAL OPERATION TIME | PUMP DISCHARGE PRESSURE | ENGINE HORSEPOWER | ENGINE SPEED | USE WORK MACHINE | OPERATION MODE | ENGINE WATER TEMPERATURE | ERROR HISTORY | FUEL EFFICIENCY |
|---|---|---|---|---|---|---|---|---|---|
| ENGINE | ○ | | ○ | ○ | | | ○ | | |
| HYDRAULIC EQUIPMENT | ○ | ○ | | | | | | | |
| ELECTRONIC EQUIPMENT | ○ | | | | | | | ○ | |
| STRUCTURE | ○ | (○) | (○) | | ○ | ○ | | | |
| OTHERS | | | | | | | | | |

FIG.4

| LEVEL | P < 50 | 50≦P<100 | 100≦P<150 | 150≦P<200 | 200≦P<250 | 250≦P<300 | 300≦P (kg/cm²) |
|---|---|---|---|---|---|---|---|
| COUNT VALUE | 1000 | 500 | 500 | 1500 | 1200 | 500 | 100 (Sec.) |

DATA STORAGE OF CONSTRUCTION MACHINE AND DATA PROCESSOR

BACKGROUND OF THE INVENTION

1. Field of the Invention

The present invention relates to a data storage of a construction machine for storing data of detected values and instructed contents of sensors and switches fitted at various positions of a construction machine to observe and control an overhaul time, a service life time, etc. of the construction machine and a data processor of a construction machine for performing data processing such as calculation of an overhaul time on the basis of data stored in the storage.

2. Disclosure of the Related Art

As to a monitoring device for controlling and monitoring an overhaul time and a service life time of the construction machine, a large number of applications, e.g., Japanese Patent Application Laid-Open No. 6-116988, have been filed and already known well.

But, such applications are to achieve monitoring by installing a special sensor and a special monitor in the construction machine. Therefore, a large number of special parts are required, resulting in a high cost.

SUMMARY OF THE INVENTION

The present invention was achieved in view of the aforesaid circumstances. And, it is an object of the invention to provide a device which can store data required for monitoring a construction machine without adding a new part to the existing parts already mounted on the construction machine and a device which can make data processing such as calculation of an overhaul time on the basis of data stored.

According to a first aspect of the invention, a data storage device for a construction machine having control means which receives a detection signal of detection means or an instruction signal of instruction means mounted on the construction machine and, on the basis of the received detection signal of the detection means or the received instruction signal of the instruction means, generates and outputs a drive control signal for controlling to drive the construction machine, wherein the data storage device comprises:

operation means which previously determines each level for indicating a content of the detection signal of the detection means or a content of the instruction signal of the instruction means, judges whichever level the detection signal of the detection means or the instruction signal of the instruction means to be input to the control means belongs to at every predetermined sampling time and adds +1 to a count value of the level to which the detection signal or the instruction signal is judged to belong; and storage means for storing values counted at every level by the operation means.

According to a second aspect of the invention, a data storage device for a construction machine having control means which receives a detection signal of detection means or an instruction signal of instruction means mounted on the construction machine and, on the basis of the received detection signal of the detection means or the received instruction signal of the instruction means, generates and outputs a drive control signal for controlling to drive the construction machine, wherein the data storage device comprises:

operation means which previously determines each level for indicating a content of the detection signal of the detection means or a content of the instruction signal of the instruction means, judges whichever level the detection signal of the detection means or the instruction signal of the instruction means to be input to the control means belongs to at every predetermined sampling time and adds +1 to a count value of the level to which the detection signal or the instruction signal is judged to belong; and storage means for storing values counted at every level by the operation means; and data processing means for performing data processing by reading the count values of the respective levels stored in the storage means from the outside.

An embodiment of the first aspect of the invention will be described. In operation section 21 of controller 7, a level indicating a content of a detection signal of individual sensors 9 to 14 or an instruction signal of switch 15 is determined first.

For example, when hydraulic pump 4 has discharge pressure P, as shown in FIG. 5, discharge pressure detection signal P is divided into such levels as $P<50$, $50 \leqq P<100$, $100 \leqq P<150$, $150 \leqq P<200$, $200 \leqq P<250$, $250 \leqq P<300$ and $300 \leqq P$. The unit of the numerical value is $kg/cm^2$.

It is judged whichever level the detection signal P which is input at every sensor readout interval (sampling time) $\Delta t$ belongs to, and a count value of the level to which the input detection signal P is judged to belong is added for sampling time $\Delta t$.

For example, it is assumed that the sampling time $\Delta t$ is one second. Then, when the pump discharge pressure signal P of the pressure sensor 10 after a lapse of the sampling time $\Delta t$ of one second from the previous sensor readout time is 200 $kg/cm^2$, the sampling time $\Delta t$ (one second) is added to a time count value of 1119 (seconds) corresponding to the level of $200 \leqq P<250$ of FIG. 5 to update the time count value to 1200 (seconds) (FIG. 5).

Thus, the time count value is stored in the storage section 22 for each magnitude level of the hydraulic pump discharge pressure signal P as shown in FIG. 5.

According to the second aspect of the invention, the time count value of each level stored in the storage section 22 is read from the outside and subject to data processing. The same processing can be performed by using the respective sensors 9, 11, 12, 13, 14 other than the sensor 10 for detecting the pump discharge pressure P.

Here, the sensors 9, 10, 11, 12, 13, 14 are existing sensors which are mounted as standard on the construction machine in order to control the engine 3 and the hydraulic pump 4. These sensors are generally mounted in order to obtain a feedback signal for controlling when the construction machine is controlled and driven. Therefore, monitoring can be effected by using the existing sensors without newly mounting a sensor for monitoring only, and it is not necessary to add a part. Thus, a cost for configuring the monitoring device can be held low.

The same processing can also be performed by using instruction signals from various switches instead of the detection signals from the sensors. For example, the mode switch 15 is an existing switch which is generally mounted as standard on the construction machine. Therefore, since the existing switch can be used, it is not necessary to add a new part for monitoring only, and a cost for configuring the monitoring device can be held low.

According to a third aspect of the invention, a data storage device for a construction machine having control means which receives a detection signal of detection means or an instruction signal of instruction means mounted on the construction machine and, on the basis of the received detection signal of the detection means or the received instruction signal of the instruction means, generates and outputs a drive control signal for controlling to drive the construction machine, wherein the data storage device comprises:

storage means for storing the detection signal of the detection means or the instruction signal of the instruction means input into the control means in connection with a detection time or an instruction time as data in a past predetermined period of time.

According to a fourth aspect of the invention, a data storage device for a construction machine having control means which receives a detection signal of detection means or an instruction signal of instruction means mounted on the construction machine and, on the basis of the received detection signal of the detection means or the received instruction signal of the instruction means, generates and outputs a drive control signal for controlling to drive the construction machine, wherein the data storage device comprises:

storage means for storing the detection signal of the detection means or the instruction signal of the instruction means input into the control means in connection with a detection time or an instruction time as data in a past predetermined period of time; and data processing means for performing data processing by reading data for the past predetermined period of time stored in the storage means from the outside.

According to the third aspect of the invention, the detection signals of the respective sensors and the instruction signal of the switch are stored in connection with the detection time and the instruction time for the past predetermined time $\tau$ as shown in FIG. 9 and FIG. 10. Contents of the stored data are updated by the contents of the latest detection signals and the instruction signal at every sampling time $\Delta t$, and the stored data of the oldest detection signal and instruction signal is erased. Thus, a time change of data for the past predetermined time $\tau$ is always stored.

For example, FIG. 9(*a*) shows stored data on the pump discharge pressure P for the past predetermined time $\tau$ stored in the storage section 22 by sequentially inputting the detection signal P of the pressure sensor 10. It is seen that the detection signal P is stored in connection with the detection time t.

According to the fourth aspect of the invention, the time series data for the past predetermined time stored in the storage section 22 is read from the outside and subject to data processing.

According to the third and fourth aspects of the invention, the existing sensors and switches mounted as standard on the construction machine are used as they are in the same way as in the first and second aspects of the invention, and it is not necessary to add a new part for monitoring only. Thus, a cost for configuring the monitoring device can be held low.

BRIEF DESCRIPTION OF THE DRAWINGS

FIG. 3 is a table showing relations between output of respective sensors and switches and respective histograms;

FIG. 4 is a table showing relations between durability of respective components of a construction machine and detection signals of respective sensors and instruction signals of respective switches;

DETAILED DESCRIPTION OF THE EMBODIMENTS

Embodiments of the invention will be described with reference to the accompanying drawings.

Figure 1:
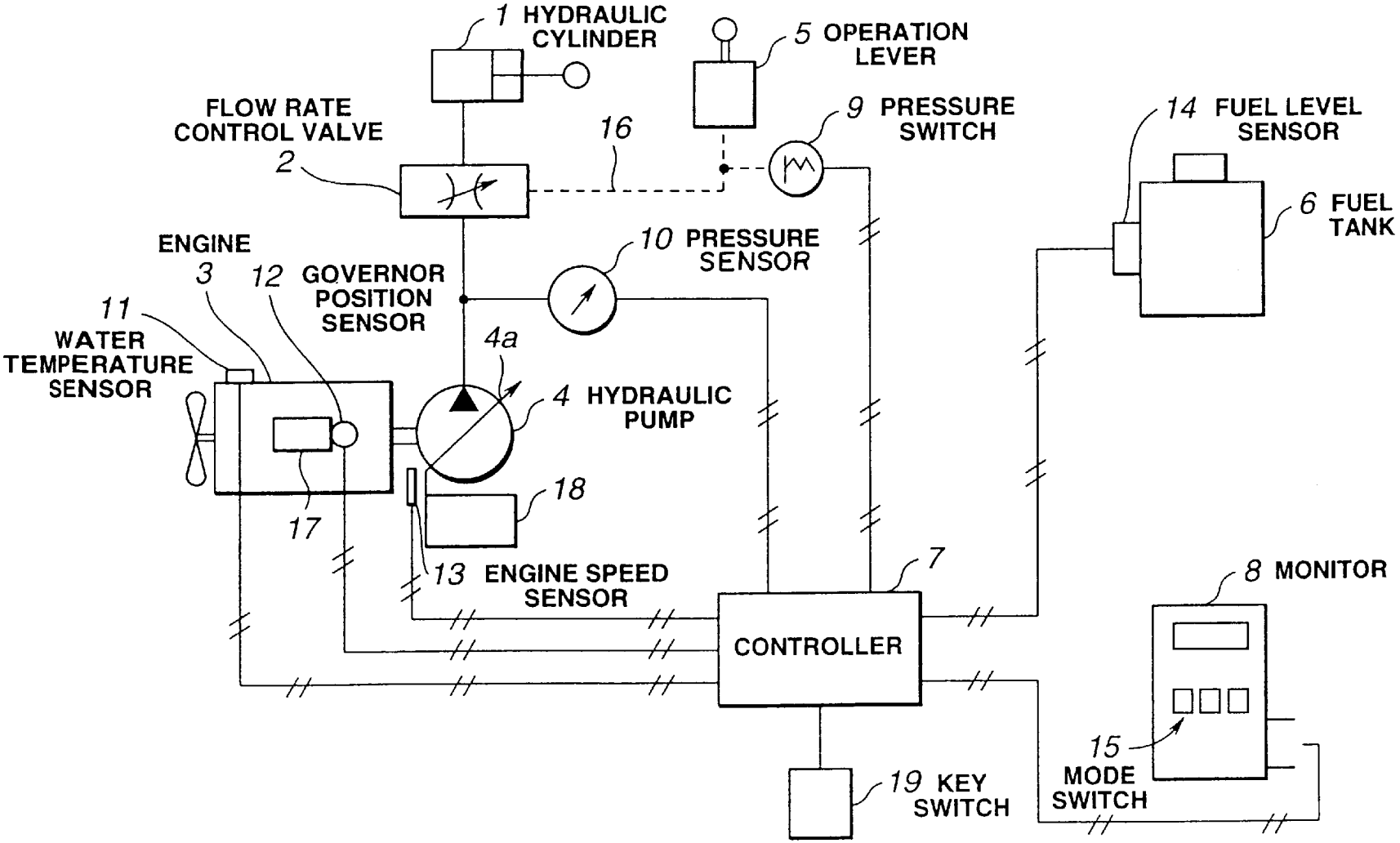
FIG. 1 is a hydraulic circuit diagram of a construction machine of an embodiment.

FIG. 1 is a hydraulic circuit diagram of a construction machine to which this embodiment is applied. In this embodiment, the construction machine is a hydraulic shovel.

Specifically, as shown in FIG. 1, this construction machine mainly comprises engine 3, variable capacity type hydraulic pump 4 driven by the engine 3, a pilot pump (not shown) which is driven by the engine 3 to supply a pilot pressure oil to pilot line 16 and the like, hydraulic cylinder 1 which is driven by receiving the pressure oil discharged from the hydraulic pump 4, flow rate control valve 2 which has its opening area changed depending on a spool stroke position to change a flow rate of the pressure oil discharged from the hydraulic pump 4 and to supply the pressure oil with its flow rate changed to the corresponding hydraulic cylinder 1, operation lever 5 which is a hydraulic lever for changing a spool stroke position of the flow rate control valve 2 depending on a manipulated variable by supplying the pilot pressure oil at a pilot pressure corresponding to a manipulated variable to an input port of the flow rate control valve 2 through the pilot line 16, a pressure switch 9 which detects that the operation lever 5 is operated for predetermined manipulated variable St or more by detecting that the pilot pressure oil through the pilot line 16 has reached a predetermined level or more, pressure sensor 10 which detects pressure P(kg/cm$^2$) of the pressure oil discharged from the hydraulic pump 4, fuel tank 6 for storing a fuel for the engine 3, fuel level sensor 14 for detecting level (an amount of the fuel remained in the fuel tank 6) F of the fuel in the fuel tank 6, water temperature sensor 11 for detecting a temperature Tm (° C.) of cooling water for the engine 3, governor 17 of a fuel injection pump for supplying the fuel to the engine 3, governor position sensor 12 as a potentiometer for detecting drive position V (control lever position) of the governor 17 by detecting a rotation angle of a motor for driving the governor 17, engine speed sensor 13 for detecting the number of revolutions Ne (rev/min) of the engine 3, swash plate driving mechanism part 18 which changes flow rate q (cc/rev) of the pressure oil discharged from the hydraulic pump 4 by changing a position (inclination angle position) of swash plate 4*a* of the hydraulic pump 4, monitor 8 which displays an operating condition of the construction machine in real time and has various switched thereon used to select and instruct a control content, mode switch 15 which is mounted on the monitor 8 to select and instruct appropriate operation mode M depending on various works performed by the construction machine, and controller 7 which controls the hydraulic pump 4 and the engine 3 by inputting the detected signals of the pressure switch 9, the pressure sensor 10, the water temperature sensor 11, the governor position sensor 12, the engine speed sensor 13 and the fuel level sensor 14 and the instruction signal of the mode switch 15, performing predetermined operation processing, and outputting a drive control signal to the swash plate driving mechanism part 18 and the governor 17. Key switch 19 is a switch which changes among "OFF", "KEY ON" and "STARTER ON" positions. And when it is changed to the KEY ON position, the controller 7 is electrically energized by a battery (not shown). Then, switching of the key switch 19 to the KEY ON position is judged by the controller 7 that KEY ON detection signal K is ON. When the key switch 19 is changed to the starter position, a starter (not shown) is operated to start the engine 3.

To keep description simple, the operation lever 5, the flow rate control valve 2 and the hydraulic cylinder 1 are shown in only one, but this construction machine in practical use is provided with boom C1, arm C2, bucket C3, upper revolving body C4, lower traveling body C5 and additional work machine C6 corresponding to a service valve. And, the same operation lever, flow rate control valve and hydraulic cylinder (hydraulic motor) are provided for such work machines.

The aforesaid various sensors 9, 10, 11, 12, 13, 14 are existing sensors which are generally mounted as the standard on the construction machine. These sensors are generally mounted to obtain a feedback signal for controlling when the construction machine is driven. Therefore, monitoring can be made by using the existing sensors without mounting a new sensor for monitoring only. Thus, a cost for configuring the monitoring device can be held low because it is not necessary to add any part.

The mode switch 15 is also an existing switch which is generally mounted as the standard on the construction machine. Therefore, this switch does not require the addition of a new part for monitoring only, and a cost for configuring the monitoring device can be held low.

This mode switch 15 is used to select to instruct an operation mode among active mode M1, heavy digging mode M2, digging mode M3, leveling mode M4, minute operation mode M5 and breaker mode M6. The breaker mode is a work mode suitable for working with a breaker mounted on the leading end of the work machine.

Now, operation performed by the controller 7 will be described with reference to the functional block diagram of FIG. 2.

Figure 2:
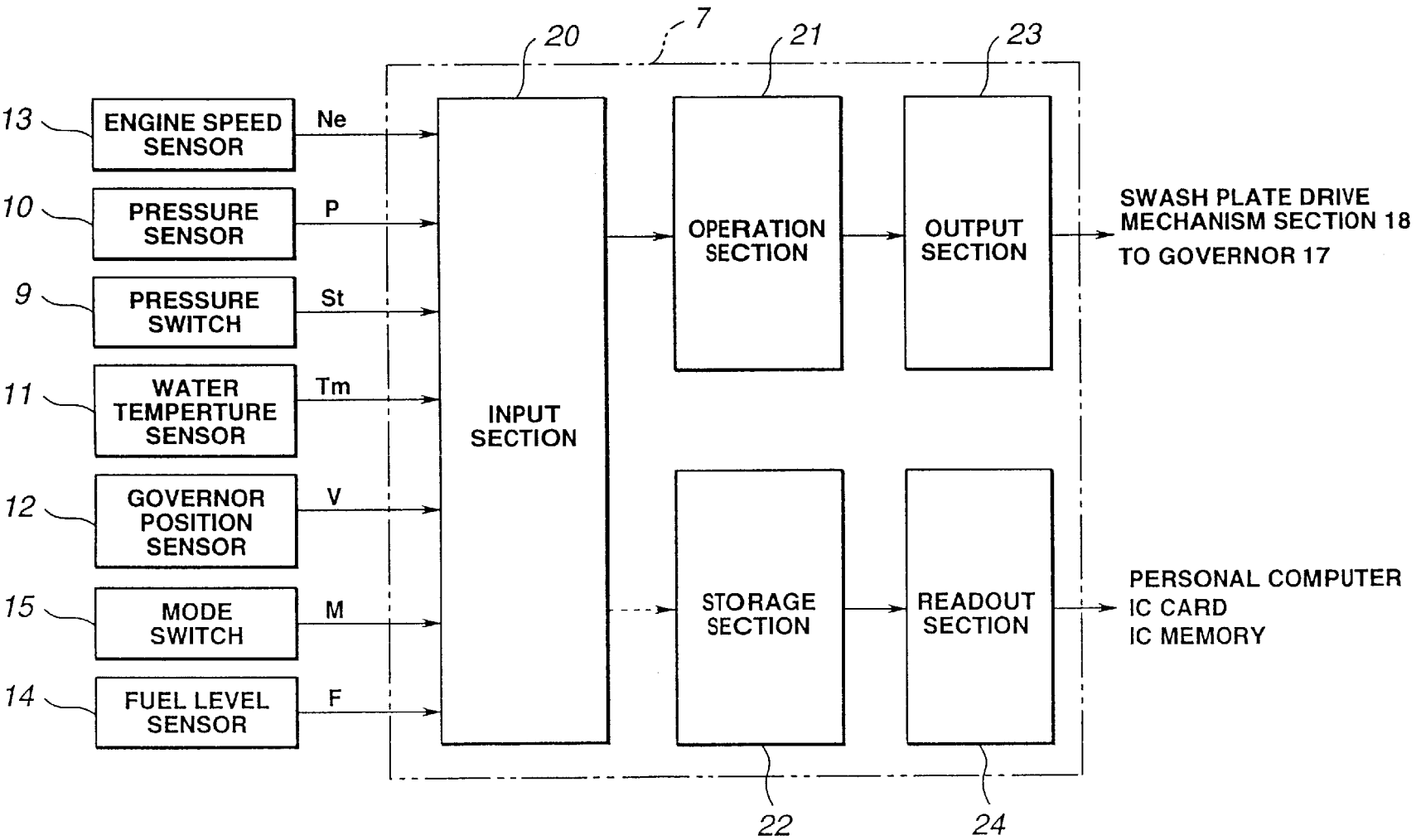
FIG. 2 is a functional block diagram showing a structure of a controller shown in FIG. 1.

As shown in FIG. 2, upon receiving rev detection signal Ne indicating the number of revolutions Ne of the engine 3, discharge pressure detection signal P indicating discharge pressure P of the hydraulic pump 4, operation detection signal St indicating that the operation lever 5 is operated for predetermined manipulated variable St or more, water temperature detection signal Tm for indicating water temperature Tm of the cooling water of the engine 3, governor position detection signal V for indicating drive position V (fuel injected amount, torque) of the governor 17, mode instruction signal M for indicating a selection instruction content by the mode switch 15 and fuel level signal F for indicating fuel level F, input section 20 of the controller 7 performs processing such as A/D conversion and inputs the result to operation section 21.

Based on the detection signals of the respective sensors and the instruction signals of the switches, the operation section 21 produces a drive control signal to the governor 17 of the engine 3 and a drive control signal to the swash plate driving mechanism section 18 for driving the swash plate 4*a* of the hydraulic pump 4 and stores data required for monitoring into the storage section 22 in a form to be described afterward.

The drive control signal to the engine 3 and the hydraulic pump 4 produced by the operation section 21 are sent to output section 23. The output section 23 performs processing such as D/A conversion of the drive control signal determined by the operation section 21 and outputs the drive control signal to the governor 17 and the swash plate driving mechanism section 18 through an electric signal line.

Data stored in the storage section 22 can be read from the outside through readout section 24.

Specifically, the readout section 24 has a function to externally read data by communication means with predetermined protocol and is connected to a personal computer, IC card, IC memory key or the like outside of the controller 7 to transmit data. When the personal computer, the IC card or the IC memory key is connected to the readout section 24, data stored in the storage section 22 is sent to the personal computer, the IC card or the IC memory key by means of predetermined communication means and stored in its built-in memory. Thus, the stored data of the storage section 22 is stored in, for example, the built-in memory of the personal computer. Then, the personal computer can perform data processing such as calculation of an overhaul time of the engine 3 of the construction machine on the basis of the stored data.

Now, processing for storing data into the storage section 22 will be described.

Processing for Storing Histograms

The operation section 21 of the controller 7 first makes processing to set each level for indicating the contents of detection signals of the sensors 9 to 14 or an instruction signal of the switch 15.

Figures 5, 6:
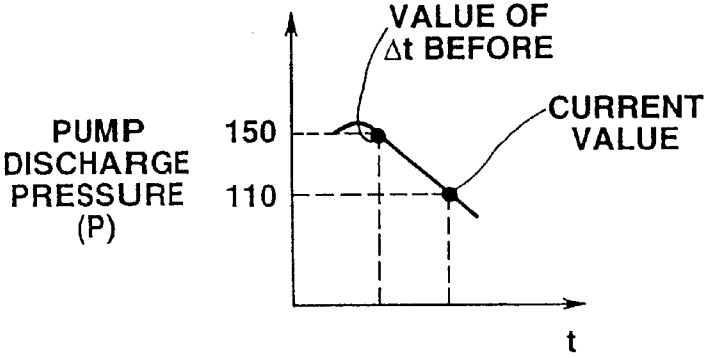
FIG. 5 is a diagram for illustrating processing to prepare a histogram.
FIG. 6 is a diagram for illustrating processing to determine an average value of a value prior to a sampling time and a current value.
Figure 7A:
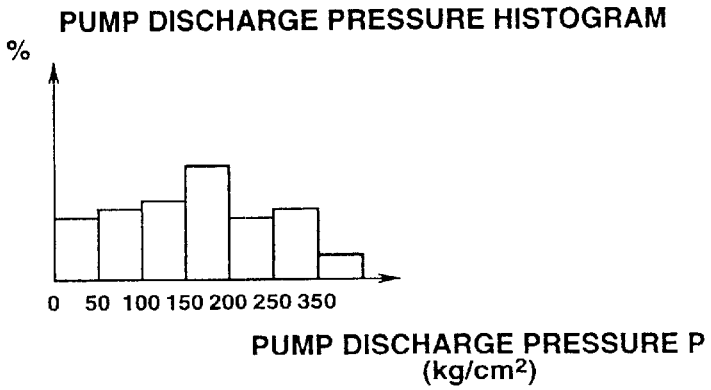
FIG. 7(*a*) is a diagram showing a pump discharge pressure histogram, FIG. 7(*b*) is a diagram showing an engine speed histogram, FIG. 7(*c*) is a diagram showing an operation mode histogram, and FIG. 7(*d*) is a diagram showing a work machine histogram.
Figure 7B:
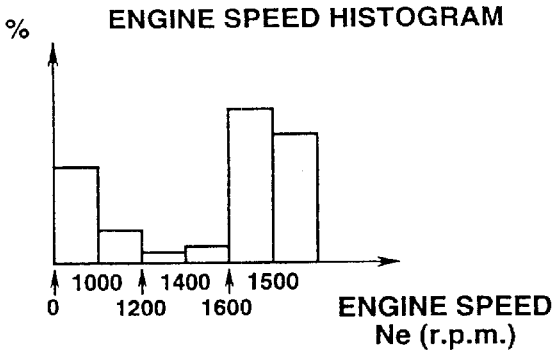
Figure 7C:
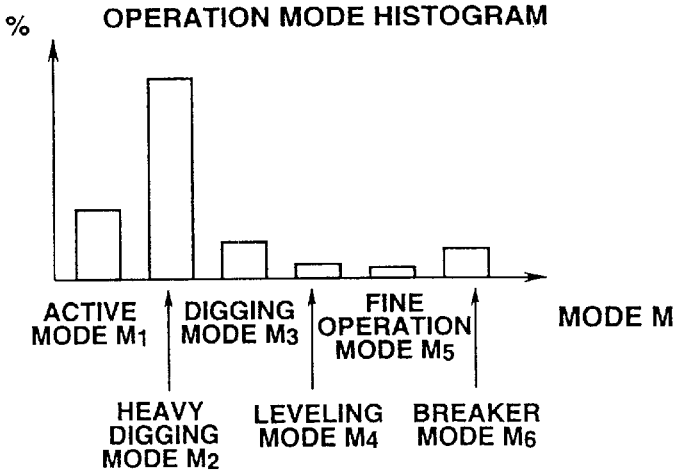
Figure 7D:
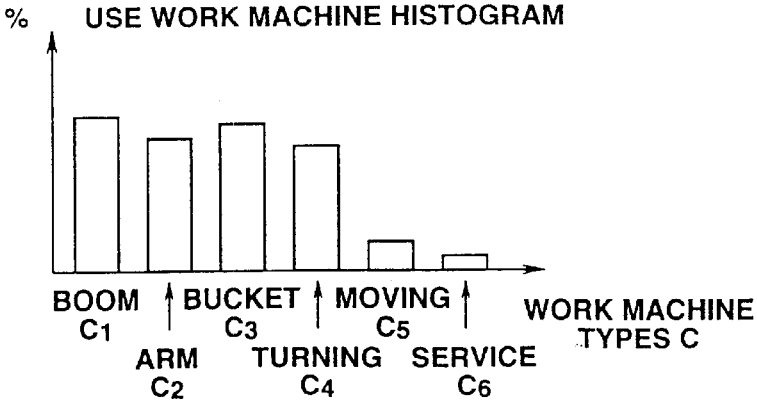

For example, when the hydraulic pump 4 has discharge pressure P, the discharge pressure detection signal P is divided into such levels as $P<50$, $50 \leqq P<100$, $100 \leqq P<150$, $150 \leqq P<200$, $200 \leqq P<250$, $250 \leqq P<300$ and $300 \leqq P$ as shown in FIG. 5. The unit of the numerical value is $kg/cm^2$.

Detection signal P which is input at every sensor readout interval (sampling time) $\Delta t$ is judged whichever level described above it belongs to, and a time count value of the level to which the input detection signal was judged to belong is added for the sampling time $\Delta t$. For example, it is assumed that the sampling time $\Delta t$ is one second.

Then, when the pump discharge pressure signal P of the pressure sensor 10 after a lapse of the sampling time $\Delta t$ of one second from the previous sensor readout time is 200 $kg/cm^2$, the sampling time $\Delta t$ (one second) is added to time count value 1119 (seconds) corresponding to the level of $200 \leqq P<250$ of FIG. 5, and the time count value is updated to 1200 (second) (FIG. 5).

It may be designed not to count the level corresponding to the detection signal P at every sampling time $\Delta t$ but to count a level corresponding to an average value of a value of the previous detection signal P before the sampling time Δt and a value of the current detection signal P after the lapse of the sampling time Δt from the previous time.

For example, when the value of the previous pump discharge pressure detection signal P is 150 kg/cm$^2$ and the value of the current pump discharge pressure detection signal P is 110 kg/cm$^2$ as shown in FIG. 6, their average value Pm=(150+110)/2=130 is determined. And, a time count value of a level 100≦P<150 to which the average value Pm=130 kg/cm$^2$ belongs may be added for the sampling time Δt (one second).

Thus, the count value at every magnitude level of the hydraulic pump discharge pressure signal P is stored in the storage section 22 as shown in FIG. 5.

As a result, the storage section 22 stores time count values N such as 1000 (sec), 500 (sec), 500 (sec), 1500 (sec), 1200 (sec), 500 (sec) and 100 (sec) in correspondence with the respective magnitude levels of the hydraulic pump discharge pressure signal P such as P<50, 50≦P<100, 100≦P<150, 150≦P<200, 200≦P<250, 250≦P<300 and 300≦P.

It may be designed not to store the time count value N as an absolute value as it is but to store the time count value N in a value converted into percentage with respect to operation time NT.

For example, the time count value N corresponding to the level P<50 is 1000 (sec). When it is converted into percentage by the operation time NT (=1000+500+500+1500+1200+500+100 (sec)), the result is 100·(N/N T)=1000/(1000+500+500+1500+1200+500+100)=18.87%.

As a result, the storage section 22 stores contents having time count value 100·(N/N T) on a percentage basis corresponded to the magnitude levels P<50, 50≦P<100, 100≦P<150, 150≦P<200, 200≦P<250, 250≦P<300 and 300≦P of the hydraulic pump discharge pressure signal P as shown in FIG. 7(*a*). Namely, a pump discharge pressure histogram was stored in the storage section 22.

The table shown in FIG. 3 shows relations among detection signals detected by the respective sensors, instruction signals instructed by the switches and respective histograms determined on the bases of the detection signals and the instruction signals. As described above, the pump discharge pressure histogram is determined from the detection signal P of the pump pressure sensor 10 for detecting the discharge pressure P of the pump 4. The pump discharge pressure histogram may be determined with the detection signal St of the pressure switch 9 taken into consideration (FIG. 3).

Similarly, by processing to input engine speed detection signal Ne from the engine speed sensor 13 at every sampling time Δt, contents having the time count value N or the time count value 100·(N/N T) on a percentage basis as shown in FIG. 7(*b*) corresponded to respective magnitude levels Ne<1000, 1000≦Ne<1200, 1200≦Ne<1400, 1400≦Ne<1600, 1600≦Ne<1800 and 1800≦Ne of the engine speed detection signal Ne are stored. Namely, an engine speed histogram is stored. Thus, the engine speed histogram is determined from the detection signal Ne of the engine speed sensor 13. The engine speed histogram may be determined with the detection signal St of the pressure switch 9 taken into consideration (FIG. 3).

Similarly, by processing to input the mode instruction signal M by the mode switch 15 at every sampling time Δt, contents having the time count value N or the time count value 100·(N/N T) on a percentage basis as shown in FIG. 7(*c*) corresponded to respective levels M1 (active mode), M2 (heavy digging mode), M3 (digging mode), M4 (leveling mode), M5 (minute operation mode) and M6 (breaker mode), which indicate contents of the respective mode instruction signals, are stored. Namely, an operation mode histogram is stored. Thus, the operation mode histogram is determined from the instruction signal M of the mode switch 15. The operation mode histogram may be determined with the detection signal St of the pressure switch 9 taken into consideration (FIG. 3).

Similarly, by processing to input the operation detection signal St from the pressure switch 9 at every sampling time Δt, contents having the time count value N or the time count value 100·(N/N T) on a percentage basis as shown in FIG. 7(*d*) corresponded to respective levels C1 (boom), C2 (arm), C3 (bucket), C4 (upper rotating body), C5 (lower traveling body) and C6 (additional work machine corresponding to the service valve), which indicate the types of the work machines being operated (used), are stored. Namely, a used work machine histogram is stored. The pressure switch 9 is mounted on each work machine (each operation lever). When a pressure switch having the operation detection signal St detected among the respective pressure switches 9 is specified, it can be distinguished which operation lever is being operated among the respective operation levers and which work machine is being used among the respective work machines. Thus, the used work machine histogram is determined from the detection signal St of the pressure switch 9 (FIG. 3).

Figure 8A:
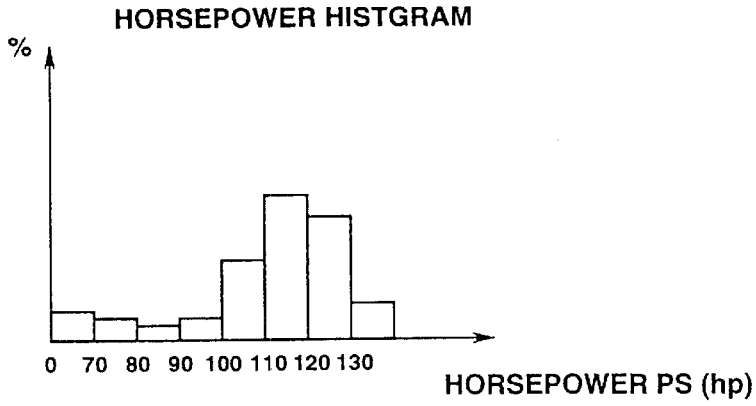
FIG. 8(*a*) is a diagram showing a horsepower histogram, FIG. 8(*b*) is a diagram showing an actual operation time histogram, and FIG. 8(*c*) is a diagram showing an engine water temperature histogram.
Figure 8B:
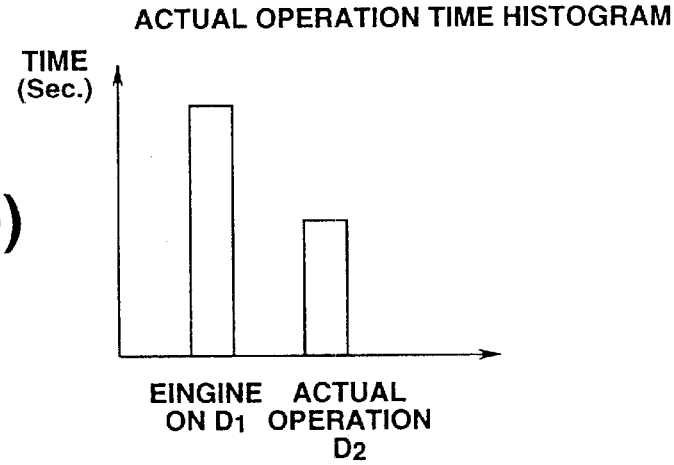
Figure 8C:
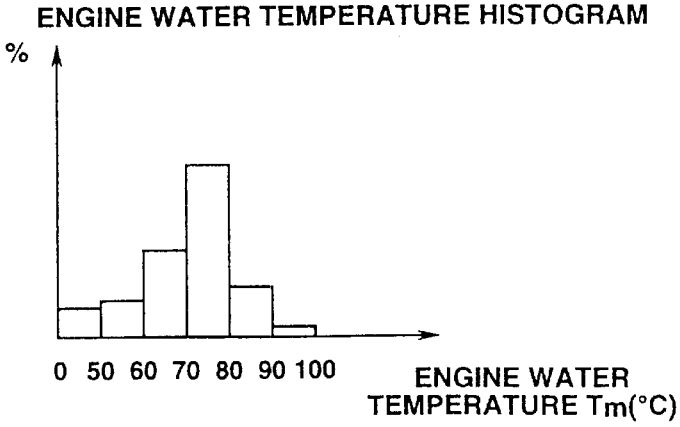
Figure 9A:
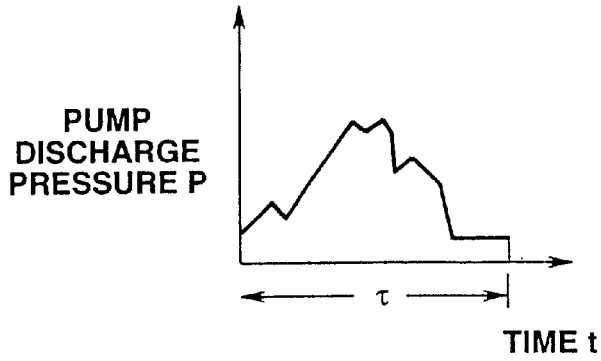
FIG. 9(*a*) is a diagram showing time series data on a pump discharge pressure, FIG. 9(*b*) is a diagram showing time series data on an engine speed, FIG. 9(*c*) is a diagram showing time series data on horsepower, and FIG. 9(*d*) is a diagram showing time series data on an engine water temperature.
Figure 9B:
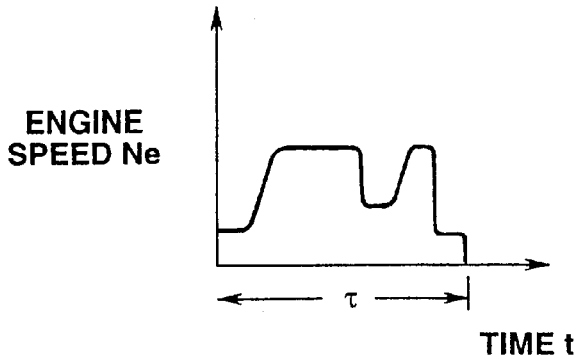
Figure 9C:
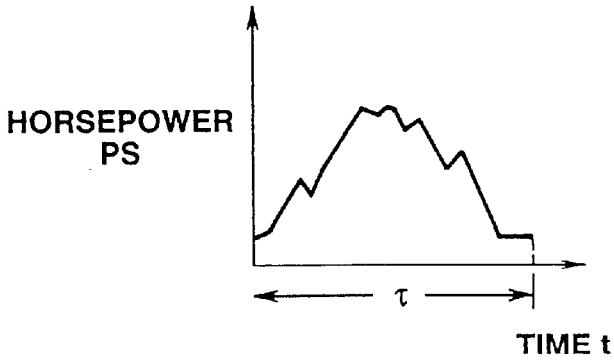
Figure 9D:
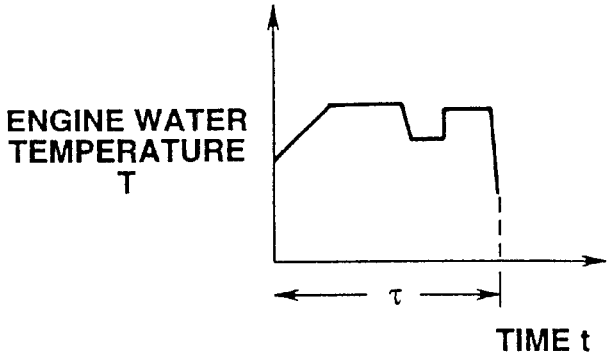

Similarly, by processing to input governor lever position detection signal V from the governor position sensor 12 and the engine speed detection signal Ne from the engine speed sensor 13 at every sampling time Δt, contents having the time count value N or the time count value 100·(N/N T) on a percentage basis as shown in FIG. 8(*a*) corresponded to respective magnitude levels PS<70, 70≦PS<80, 80≦PS<90, 90≦PS<100, 100≦PS<110, 110≦PS<120, 120≦PS<130 and 130≦PS of horsepower PS (hp) of the engine 3 are stored. Namely, a horsepower histogram is stored. The horsepower PS of the engine 3 is obtained by multiplying a torque by the engine speed Ne, and the torque is determined from an engine torque curve (a relation between the torque and the engine speed) stored in the storage section. Besides, the horsepower histogram may be determined with the instruction signal M by the work mode switch 15, the detection signal St from the pressure switch 9 and the set position detection signal of a fuel dial taken into consideration (FIG. 3).

Similarly, by processing to input operation detection signal St from the pressure switch 9, key on detection signal K ON from the key switch 19 and governor position detection signal V from the governor position sensor 12 at every sampling time Δt, contents having time count value N (second) corresponded to D1 and D2 indicating the engine on time D1 during which the engine 3 is ON and actual operation time D2 during which the engine 3 is ON and the work machine C is operating as shown in FIG. 8(*b*) are stored. Namely, an actual operation time histogram is stored.

The engine on time D1 is a time when the main key 19 is turned on and the engine 3 is operating, including a time when the work machine is not operating. The engine on time D1 is determined as a time when the key on detection signal K ON is being output from the key switch 19 and the governor position signal V detected by the governor position sensor 12 is at a predetermined threshold value or more (the engine 3 is operating). Meanwhile, the actual operation time D2 is a time when the engine 3 is operating and at least one of the respective work machines C is operating, and determined as a time when the governor position signal V detected by the governor position sensor 12 is at a predetermined threshold value or more (the engine 3 is operating)

and the operation detection signal St is being output from the pressure switch 9 (the work machine C is operating) (FIG. 3).

Similarly, by processing to input water temperature detection signal Tm from the water temperature sensor 11 at every sampling time Δt, contents having the time count value N or the time count value 100·(N/N T) on a percentage basis as shown in FIG. 8(*c*) corresponded to magnitude levels Tm<50, 50≦Tm<60, 60≦Tm<70, 70≦Tm<80, 80≦Tm<90 and 90≦Tm<100 of the water temperature detection signal Tm are stored. Namely, an engine water temperature histogram is stored. Thus, the water temperature histogram is determined from the detection signal Tm of the water temperature sensor 11.

A specific example of data processing for calculating an overhaul time of the construction machine components from the histogram obtained as described above will be described.

For example, when data stored in the storage section 22 is stored into a built-in memory of a personal computer through the readout section 24, a service life time of the engine 3 is calculated on the basis of the stored data as follows.

It is assumed that the contents of the horsepower histogram of FIG. 8(*a*) are stored in the built-in memory of the personal computer.

Then, the personal computer assigns weight ki to time count value αi=100·(Ni/N T) on a percentage basis and computes a deterioration coefficient which becomes an index to indicate an actual amount of damage (mainly abrasion of the engine) applied to the engine 3 as follows:

$$\gamma f = \sum_i \alpha i \cdot ki \tag{1}$$

Here, i is a code for specifying a level, i=1 corresponds to level PS<70, i=2 corresponds to level 70≦PS<80, i=3 corresponds to level 80≦PS<90, i=4 corresponds to level 90≦PS<100, i=5 corresponds to level 100≦PS<110, i=6 corresponds to level 110≦PS<120, i=7 corresponds to level 120≦PS<130, and i=8 corresponds to level 130≦PS.

Meanwhile, weight coefficient ki is a value previously determined by performing a durability test when the engine 3 was developed. By operating the engine 3 under the conditions of the durability test, time count value βi=100·(Ni/N T), which has the time count value of the engine horsepower PS undergone percentage conversion, is determined. And, the weight ki is determined for each level of the horsepower PS of the engine 3 according to a degree of abrasion of the engine 3. The weight ki may be determined from experience when the durability test is performed. Otherwise, it may be determined by calculating a theoretical value.

Therefore, deterioration coefficient γt under the conditions of the durability test is previously determined and set by the following expression (2) in the same way as the aforesaid expression (1):

$$\gamma t = \Sigma \beta i \cdot ki \tag{2}$$

As shown by the expression (1), the deterioration coefficient γf indicates a large value as the engine 3 is operated at the horsepower PS with a large weight ki for a longer time.

And, the average service life time Lt of the engine 3 under the conditions of the durability test is also determined in advance. The average service life time Lt of the engine 3 under the conditions of the durability test is presumed from experience.

Therefore, on the basis of the relation between the deterioration coefficient γt under the previously determined conditions of the durability test and the average service life time Lt with respect to the degradation coefficient γt, the average service life time Lf of the engine 3 when it is actually operated is presumably calculated by the following expression (3).

$$Lf = (\gamma t / \gamma f) \cdot Lt \tag{3}$$

And, the determined service life time Lf is shown on the display of the personal computer as a predicted service life time of the engine 3.

FIG. 4 shows relations between the durability of each component of the construction machine, namely the durability of the engine 3, the hydraulic equipment (hydraulic pump 4 etc.), electronic equipment (the controller 7, the monitor 8, etc.), a structure (work machine C etc.) and other components and the aforesaid actual operation times D1, D2, the pump discharge pressure P, the engine horsepower PS, the engine speed Ne, the used work machine C, the operation mode M, the engine water temperature Tm and the error history. Here, the error history means errors caused in the controller 7.

As shown in FIG. 3, the durability of the engine 3 and the engine horsepower PS are mutually related, so that the service life time of the engine 3 can be predicted from the horsepower histogram. According to circumstances, since the structure of the construction machine is related to the engine horsepower PS, the service life time of the structure may be predicted from the horsepower histogram.

As shown in FIG. 4, the durability of the engine 3, the hydraulic equipment, the electronic equipment and the structure is related to the actual operation times D1, D2, so that the service life time of the engine 3, the hydraulic equipment, the electronic equipment and the structure may be determined on the basis of the actual operation time histogram.

Similarly, since the hydraulic equipment and also the service life time of the structure depending on the situation are related to the pump discharge pressure P, the hydraulic equipment and also the service life time of the structure depending on the situation may be determined on the basis of the pump discharge pressure histogram.

Similarly, since the durability of the engine 3 is related to the engine speed Ne, the service life time of the engine 3 can be determined on the basis of the engine speed histogram.

Similarly, since the durability of the structure is related to the used work machine C, the service life time of the structure can be determined on the basis of the used work machine histogram.

Similarly, since the durability of the structure is related to the operation mode M, the service life time of the structure can be determined on the basis of the operation mode histogram.

Similarly, since the durability of the engine 3 is related to the engine water temperature Tm, the service life time of the engine 3 can be determined on the basis of the water temperature histogram.

Similarly, since the durability of the electronic equipment is related to the error history, the service life time of the electronic equipment can be determined on the basis of the error history histogram.

Processing for Storing Time Series Data

The operation section 21 of the controller 3 processes to store time series data on the detection signals of the respective sensors and the instruction signal of the switch into the storage section 22 apart from the aforesaid histograms.

Figure 10A:
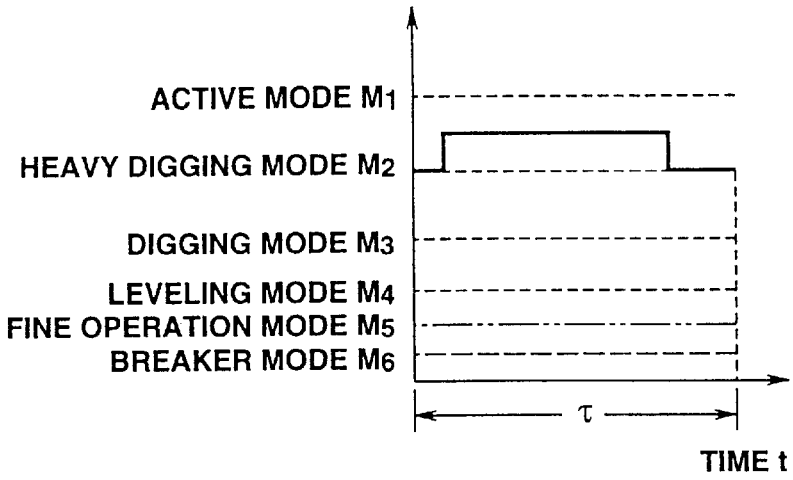
FIG. 10(*a*) is a diagram showing time series data on operation modes, and FIG. 10(*b*) is a diagram showing time series data on work machines.
Figure 10B:
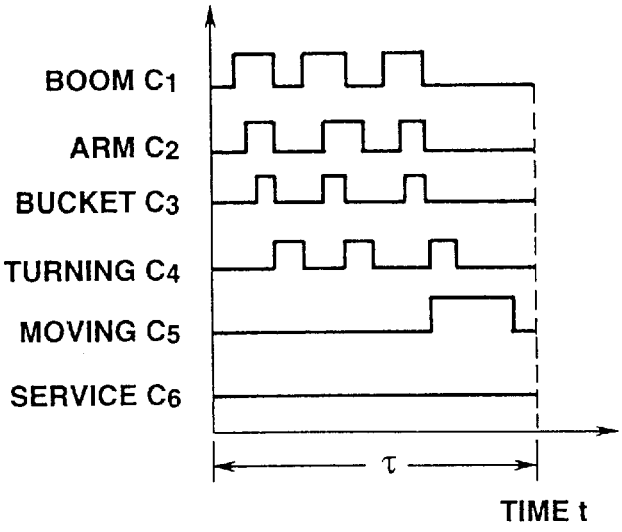

Specifically, as shown in FIG. 9 and FIG. 10, the detection signals of the respective sensors and the instruction signal of the switch are stored in connection with the detection time and the instruction time for past predetermined time τ. Contents of the stored data are updated by the latest detection signal and instruction signal at every sampling time Δt and the oldest stored data is erased. Thus, a change of data with time is always stored for the past predetermined time τ only.

FIG. 9(*a*) shows stored data on the pump discharge pressure P for the past predetermined time τ stored in the storage section 22 by sequentially inputting the detection signal P of the pressure sensor 10, and the detection signal P is stored in connection with the detection time t.

Similarly, FIG. 9(*b*) shows stored data on the engine speed Ne for the past predetermined time τ stored in the storage section 22 by sequentially inputting the detection signal Ne of the engine speed sensor 13, and the detection signal Ne is stored in connection with the detection time t.

Similarly, FIG. 9(*c*) shows stored data on the horsepower PS for the past predetermined time τ stored in the storage section 22 by sequentially inputting the detection signal Ne of the engine speed sensor 13 and the detection signal V of the governor position sensor 12, and the horsepower PS is stored in connection with the detection signal t.

Similarly, FIG. 9(*d*) shows stored data on the water temperature Tm for the past predetermined time τ stored in the storage section 22 by sequentially inputting the detection signal Tm of the water temperature sensor 11, and the detection signal Tm is stored in connection with the detection time t.

Similarly, FIG. 10(*a*) shows stored data on the instruction mode M for the past predetermined time τ stored in the storage section 22 by sequentially inputting the instruction signal M of the mode switch 15, and contents of the instruction signal M are stored in connection with the instruction time t.

Similarly, FIG. 10(*b*) shows stored data on type C of the used work machine for the past predetermined time τ stored in the storage section 22 by sequentially inputting the detection signal St of the pressure switch 9, and the type C of the used work machine is stored in connection with the detection time t.

Then, data processing such as calculation of the overhaul time is performed based on the time series data for the past predetermined time τ obtained as described above.

For example, when the stored data of the storage section 22 is stored in the built-in memory of the personal computer through the readout section 24, the service life time of each component of the construction machine is calculated on the basis of the stored data.

For example, since the durability of the engine 3 is related to the engine horsepower PS as shown in FIG. 4, the service life time of the engine 3 can be predicted by comparing the time series data on the horsepower shown in FIG. 9(*c*) with the predetermined time series data on the horsepower used in a standard way. Depending on the situation, the service life time of the structure may be predicted on the basis of the time series data on the horsepower shown in FIG. 9(*c*) because the structure of the construction machine and the engine horsepower PS are mutually related.

Similarly, since the hydraulic equipment and also the durability of the structure depending on the situation are related to the pump discharge pressure P, the hydraulic equipment and also the service life time of the structure depending on the situation can be predicted on the basis of the time series data on the pump discharge pressure shown in FIG. 9(*a*).

Similarly, since the durability of the engine 3 is related to the engine speed Ne, the service life time of the engine 3 can be predicted on the basis of the time series data on the engine speed shown in FIG. 9(*b*).

Similarly, since the durability of the structure is related to the used work machine C, the service life time of the structure can be predicted on the basis of the time series data on the used work machine as shown in FIG. 10(*b*).

Similarly, since the durability of the structure is related to the operation mode M, the service life time of the structure can be predicted on the basis of the time series data on the operation mode shown in FIG. 10(*a*).

Similarly, since the durability of the engine 3 is related to the engine water temperature Tm, the service life time of the engine 3 can be predicted on the basis of the time series data on the water temperature shown in FIG. 9(*d*).

Similarly, since the durability of the electronic equipment is related to the error history, the service life time of the electronic equipment can be predicted on the basis of the time series data on the error history.

As described above, according to this embodiment, the detection signals and the instruction signals of the respective sensors and switch mounted on the construction machine are used to store the detection signals and the instruction signals, so that data required for monitoring can be stored by adding a slight change to the controller 7 in which the detection signals of the sensors and the instruction signal of the switch are input and such data for data processing can be read from the outside.

Therefore, it is not necessary to mount a new special sensor in order to configure a monitoring system for the construction machine as before, and an addition of a special monitor is not required. Thus, a cost can be decreased substantially. Therefore, by slightly modifying a large number of construction machines available on the market, it becomes possible to collect data indicating the operation condition of the construction machine, and data processing can be performed accurately by collecting data indicating the operation condition from a large number of vehicles.

What is claimed is:

1. A data storage device for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a pump discharge pressure and, wherein the data storage device comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong; and storage means for storing values counted at every level by the operation means.

2. A data storage device for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of type of a working machine being used and, wherein the data storage device comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong; and storage means for storing values counted at every level by the operation means.

3. A data storage device for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a horsepower of an engine and, wherein the data storage device comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong; and storage means for storing values counted at every level by the operation means.

4. A data storage device for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of an actual working time of an engine and, wherein the data processing device comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong; and storage means for storing values counted at every level by the operation means.

5. A data processing device for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a temperature of cooling water of an engine and, wherein the data storage device comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong; and storage means for storing values counted at every level by the operation means.

6. A data storage device for a construction machine having control means which receives an instruction signal of instruction means mounted on the construction machine and, on the basis of the received instruction signal of the instruction means, generates and outputs a drive control signal for controlling to drive the construction machine, wherein the instruction signal of instruction means is a signal indicative of a usage mode of the construction machine and, wherein the data storage device comprises:

operation means which previously determines each level for indicating a content of the instruction signal of the instruction means, judges whichever level the instruction signal of the instruction means to be input to the control means belongs to at every predetermined sampling time and adds +1 to a count value of the level to which the instruction signal is judged to belong; and storage means for storing values counted at every level by the operation means.

7. A data processing system for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a pump discharge pressure and, wherein the data processing system comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong;

storage means provided in the construction machine for storing values counted at every level by the operation means; and data processing means removably connectable to the storage means, for performing data processing by reading the count values of the respective levels stored in the storage means.

8. A data processing system for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of type of a working machine being used and, wherein the data processing system comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong;

storage means provided in the construction machine for storing values counted at every level by the operation means; and data processing means removably connectable to the storage means, for performing data processing by reading the count values of the respective levels stored in the storage means.

9. A data processing system for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a horsepower of an engine and, wherein the data processing system comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong;

storage means provided in the construction machine for storing values counted at every level by the operation means; and data processing means removably connectable to the storage means, for performing data processing by reading the count values of the respective levels stored in the storage means.

10. A data processing system for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of an actual working time of an engine and, wherein the data processing system comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong;

storage means provided in the construction machine for storing values counted at every level by the operation means; and data processing means removably connectable to the storage means, for performing data processing by reading the count values of the respective levels stored in the storage means.

11. A data processing system for a construction machine having control means which receives a detection signal of detection means mounted on the construction machine and, on the basis of the received detection signal of the detection means, generates and outputs a drive control signal for controlling to drive the construction machine, wherein the detection signal of the detection means is a signal indicative of a temperature of cooling water of an engine and, wherein the data processing system comprises:

operation means which previously determines each level for indicating a content of the detection signal of the detection means, judges whichever level the detection signal of the detection means to be input to the control means belongs to at every predetermined sampling time and adds +1 to a count value of the level to which the detection signal is judged to belong;

storage means provided in the construction machine for storing values counted at every level by the operation means; and data processing means removably connectable to the storage means, for performing data processing by reading the count values of the respective levels stored in the storage means.

12. A data processing system for a construction machine having control means which receives an instruction signal of instruction means mounted on the construction machine and, on the basis of the received instruction signal of the instruction means, generates and outputs a drive control signal for controlling to drive the construction machine, wherein the instruction signal of instruction means is a signal indicative of a usage mode of the construction machine and, wherein the data processing system comprises:

operation means which previously determines each level for indicating a content of the instruction signal of the instruction means, judges whichever level the instruction signal of the instruction means to be input to the control means belongs to at every predetermined sampling time and adds +1 to a count value of the level to which the instruction signal is judged to belong, storage means provided in the construction machine for storing values counted at every level by the operation means; and data processing means removably connectable to the storage means, for performing data processing by reading the count values of the respective levels stored in the storage means.

13. A data storage device for a construction machine having control means which receives a detection signal of detection means mounted on the construction machine and, on the basis of the received detection signal of the detection means, generates and outputs a drive control signal for controlling to drive the construction machine, wherein the detection signal of detection means relates to a working machine being used and, wherein the data storage device comprises:

storage means for storing the detection signal of the detection means input into the control means as data in connection with a detection time in a predetermined period of time from the detection time.

14. A data storage device for a construction machine having control means which receives a detection signal of detection means mounted on the construction machine and, on the basis of the received detection signal of the detection means, generates and outputs a drive control signal for controlling to drive the construction machine, wherein the detection signal of detection means is a signal indicative of a horsepower of an engine and, wherein the data storage device comprises:

storage means for storing the detection signal of the detection means input into the control means as data in connection with a detection time in a predetermined period of time from the detection time.

15. A data storage device for a construction machine having control means which receives an instruction signal of instruction means mounted on the construction machine and, on the basis of the received instruction signal of the instruction means, generates and outputs a drive control signal for controlling to drive the construction machine, wherein the instruction signal of the instruction means is a signal indicative of a usage mode of the construction machine and, wherein the data storage device comprises:

storage means for storing the instruction signal of the instruction means input into the control means as data in connection with an instruction time in a predetermined period of time from the instruction time.

16. A data processing system for a construction machine having control means which receives a detection signal of detection means mounted on the construction machine and, on the basis of the received detection signal of the detection means, generates and outputs a drive control signal for controlling to drive the construction machine, wherein the detection signal of detection means is a signal indicative of type of a working machine being used and, wherein the data processing system comprises:

storage means provided in the construction machine for storing the detection signal of the detection means input into the control means as data in connection with a detection time in a predetermined period of time from the detection time; and data processing means removably connectable to the storage means, for performing data processing by reading data for the predetermined period of time stored in the storage means.

17. A data processing system for a construction machine having control means which receives a detection signal of detection means mounted on the construction machine and, on the basis of the received detection signal of the detection means, generates and outputs a drive control signal for controlling to drive the construction machine, wherein the detection signal of detection means is a signal indicative of a horsepower of an engine and, wherein the data processing system comprises:

storage means provided in the construction machine for storing the detection signal of the detection means input into the control means as data in connection with a detection time in a predetermined period of time from the detection time, and data processing means removably connectable to the storage means, for performing data processing by reading data for the predetermined period of time stored in the storage means.

18. A data processing system for a construction machine having control means which receives an instruction signal of instruction means mounted on the construction machine and, on the basis of the received instruction signal of the instruction means, generates and outputs a drive control signal for controlling to drive the construction machine, wherein the instruction signal of the instruction means is a signal indicative of a usage mode of the construction machine and, wherein the data processing system comprises:

storage means provided in the construction machine for storing the instruction signal of the instruction means input into the control means as data in connection with an instruction time in a predetermined period of time from the instruction time, and data processing means removably connectable to the storage means, for performing data processing by reading data for the predetermined period of time stored in the storage means.

* * * * *